United States Patent [19]

Watanabe et al.

[11] B 4,013,004

[45] Mar. 22, 1977

[54] INK MIST TYPE HIGH SPEED PRINTER

[75] Inventors: Akinori Watanabe; Katsuhide Tanoshima; Matsusaburo Noguchi, all of Tokyo, Japan

[73] Assignee: Oki Electric Industry Company, Ltd., Tokyo, Japan

[22] Filed: Dec. 3, 1974

[21] Appl. No.: 529,214

[44] Published under the second Trial Voluntary Protest Program on April 20, 1976 as document No. B 529,214.

[30] Foreign Application Priority Data

Dec. 10, 1973 Japan ..... 48-136885

[52] U.S. Cl. ..... 101/1; 101/DIG. 13; 346/153

[51] Int. Cl.[2] ..... G03G 15/04

[58] Field of Search ..... 101/1, 114, DIG. 13; 355/3; 346/74 ES

[56] References Cited

UNITED STATES PATENTS

| | | | |
|---|---|---|---|
| 3,370,212 | 2/1968 | Frank | 317/262 |
| 3,370,529 | 2/1968 | Michalchik | 101/1 |
| 3,402,658 | 9/1968 | Opdycke | 101/129 |
| 3,521,558 | 7/1970 | Fisher et al. | 101/114 |
| 3,625,604 | 12/1971 | Pressman | 355/3 |
| 3,647,291 | 3/1972 | Pressman | 355/3 |
| 3,689,935 | 9/1972 | Pressman | 101/DIG. 13 |
| 3,779,166 | 12/1973 | Pressman | 101/426 |

FOREIGN PATENTS OR APPLICATIONS

| | | | |
|---|---|---|---|
| 719,239 | 12/1954 | United Kingdom | 101/DIG. 13 |

*Primary Examiner*—J. Reed Fisher
*Attorney, Agent, or Firm*—Lewis H. Eslinger

[57] ABSTRACT

A conductive shield board for protecting an aperture board from discharge is mounted between a positive electrode and said aperture board in an ink mist type high speed printer.

The ink mist type printer operates on the principle that an ion stream modulated by an aperture board according to the pattern of the character to be printed, charges the ink mist, which is then attracted by an electric field, to the surface of the paper. However, a high potential on a positive electrode for generating said ion stream sometimes causes an undesirable discharge between the positive electrode and the aperture board.

In order to avoid said undesirable discharge, a conductive shield board is inserted between the positive electrode and the aperture board.

3 Claims, 9 Drawing Figures

INK MIST TYPE HIGH SPEED PRINTER

BACKGROUND OF THE INVENTION

The present invention relates to an ink mist type high speed printer.

The operational speed of an information processing system including a computer system has recently been improved, thus requiring the use of a high speed peripheral device including a printer. A conventional high speed printer is a line printer with a type drum or a type train. However, this line printer has many disadvantages, some of which are that the operational speed is not sufficient for the latest information processing system, and the process involves a high level of sound noise and/or limitation of the number of printing types. In order to overcome these disadvantages, some high speed printers with new operational principles have been developed. Among them, one of the most promising is an ink mist type printer, which operates at high speed, i.e. 8,000 lines per minute, with a low sound noise level. Further, it can type not only alphanumeric characters but also Chinese or Japanese characters.

The operational principle of an ink mist type printer is that an ion stream generated by corona discharge passes through apertures of an aperture board and ionizes an ink mist, and the movement of the electrically charged ink mist is accelerated by a negative electrode and is attached to paper according to the pattern of characters.

The main disadvantage of the prior ink mist type printer is that a positive electrode for generating said ion stream sometimes causes an undesirable discharge between the positive electrode and the aperture board. Said undesirable discharge damages a drive circuit connected to a selection electrode of the aperture board, and further, the aperture board is corroded by ozone gas generated by said undesirable discharge.

SUMMARY OF THE INVENTION

The general purpose of the present invention is to provide an improved ink mist type printer with a facility for preventing said undesirable discharge.

It is an object, therefore, of the present invention to overcome the disadvantage of the prior ink mist type printer by providing a shield board. According to the present invention, a conductive shield board is inserted between the aperture board and the positive electrode, in order to prevent said undesired discharge.

BRIEF DESCRIPTION OF THE DRAWINGS

The foregoing and other objects, features, and attendant advantages of the present invention will be appreciated as they become better understood by reference to the accompanying drawings, wherein.

DETAILED DESCRIPTION OF THE PREFERRED EMBODIMENTS

First, the operational principle of an ink mist type printer will be explained to provide a basis for understanding of the present invention.

Figure 2A:
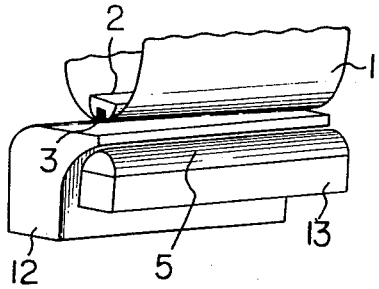
FIG. 2 A through 2 C show a conventional aperture board.
Figure 1:
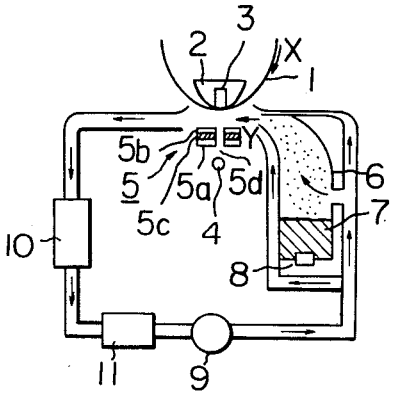
FIG. 1 shows (the explanatory) sectional view of a conventional ink mist type printer.

FIG. 1 shows a basic structure of a prior ink mist type printer. The principle of typing in an ink mist type printer is to attach an ion stream to an ink mist which types or draws characters on a printing medium such as a sheet of paper. Said ion stream is controlled by an electric field on an aperture board according to the pattern or shape of said printed characters. In FIG. 1, an aperture board 5 is positioned between a positive electrode 4 and printing medium 1, which is ordinary paper. A negative electrode 3 is provided behind the printing medium 1 and doubles as a platen. The positive electrode 4 is a thin straight line made of tungsten. Several thousand voltages applied to the positive electrode 4 generates a corona discharge and an ion stream.

Figure 2:
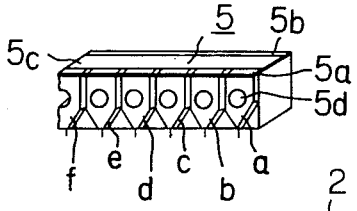
Figure 2B:
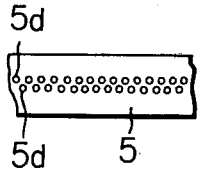

The strength of electrical field required for corona discharge depends upon the shape of the positive electrode 4 and is generally 1000 – 1300 V/mm. The movement of the ion stream generated on the positive electrode 4 is accelerated by the negative electrode 3 and passes through apertures 5*d* of the aperture board 5, the structure of which is shown in detail in FIGS. 2 A, 2 B and 2 C, wherein reference number 5*c* is a dielectric layer, 5a and 5b are conductive layers; 5*d* are aperture, 12 is a frame of a printer and 13 is an aperture leg for supporting said aperture board 5. FIG. 2 A shows a perspective view of the aperture board 5. On the top thereof, are a plurality of apertures 5*d* arranged in two lines as shown in FIG. 2 B. FIG. 2 C is an enlarged view of one aperture 5*d* on the aperture board 5. (Only one line of apertures are shown.)

The conductive layer 5*a* is separated by a plurality of cells shown as *a*, *b*, *c*, *d*, . . ., each of which is insulated from the others. On the other hand, the conductive layer 5*b* is common to all said cells.

The aperture board 5 is, actually, composed of a thin dielectric layer, on both surfaces of which conductive layers are printed as a selection electrode 5*a* and a common electrode 5*b*. Said plurality of apertures 5*d* penetrate a selection electrode, a dielectric layer and a common electrode. A voltage E is applied to each cell of the conductive layers 5*a* and 5*b* and the distribution of voltage E is related to the pattern or shape of the character to be printed. An electric field generated in the aperture by said voltage E prevents or accelerates the passage of the ion stream according to the polarity of the voltage E, therefore, the density of the ion stream which comes out of the aperture board 5 is modulated accoring to the pattern of the character. Voltage E is supplied by a character generator (not shown).

An ink mist is located between the aperture board 5 and printing medium 1. The ion stream modulated by the aperture 5 attacks and charges the particles of the ink mist, then, the charged particles of the ink mist are accelerated by the negative electrode 3 and attached to the surface of the printing medium 1. Thus, the pattern of the character is printed on the printing medium in ink.

An ink mist generator comprises an ink tank 6 containing ink 7, and an ultrasonic wave exciter 8. The depth of ink 7 in the ink tank 6 is automatically maintained at a desirable depth. The exciter 8 generates both ultrasonic waves and ink mist, the diameter of which is 5 – 20 $\mu$. The ink mist is transported by an air stream to an ink guide, and directed along arrow Y in the same direction as the movement of said paper 1. The moving speed of the ink mist is almost the same as that of the paper 1. The ink mist which is not used for printing is gathered and condensed in a tank (not shown).

One problem of a conventional ink mist type printer is, as explained before, that an undesired discharge occurs between the positive electrode 4 and the aperture board 5 due to the high potential on the positive electrode 4.

Figure 3A:
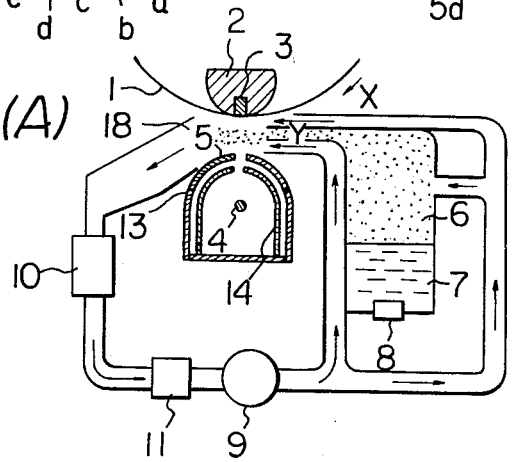
FIG. 3 A and B show a sectional view of an ink mist type printer according to the present invention.
Figure 3B:
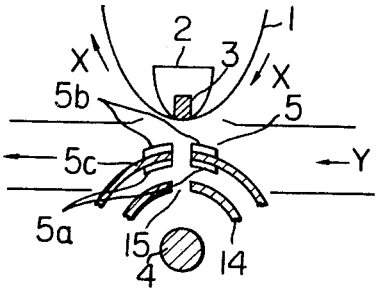
Figure 4:
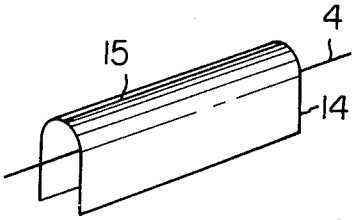
FIG. 4 is an enlarged view of one shield board 14 in FIG. 3 A.

FIG. 3 A is a simplified view showing the sectional view of the main printing part of the ink mist type high speed printer, according to the present invention, and FIG. 3 B is an enlarged view of a main portion of FIG. 3 A. In FIGS. 3 A, and 3 B, 1 indicates a recording paper running in the direction indicated by an arrow *x*, 2 is a platen disposed on the back of the recording paper 1 and installed with a negative electrode 3, 4 is a positive electrode composed of a thin wire made of tungsten, 5 is an aperture board including a selection electrode 5*a*, a common electrode 5*b* and an insulating member 5*c* interposed between the two electrodes and having a plurality of penetrating apertures 5*d* aligned in the lengthwise direction thereof, 6 is a mist tank for vibrating and atomizing an ink solution 7 by applying an electric pulse to an ultrasonic exciter 8 composed of a piezo-electric material, 9 is a main pump for feeding air to the mist tank 6, 10 is a condenser for separating the ink from air recovered from the printing zone, 11 is a cooler and 13 is an aperture leg for supporting the aperture. 14 denotes an electrically conductive shield board disposed close to the aperture board 5, between said aperture board 5 and the positive electrode 4. The shield board 14 is in an inverted U-shaped cross-section over a thin wire of the positive electrode 4 as shown in detail in FIG. 4. A long slit 15 is provided on the top of the conductive shield board 14 at a position corresponding to ion-passing apertures of the aperture board 5. In order to improve the effect of the shield board 14, an appropriate potential, for instance an earth potential, could be applied to the shield board 14, although it is not necessary since the shield board 14 is sufficiently effective as it is.

Ions for causing ink particles to stick on the recording paper 1 go through said slit 15 from the positive electrode 4 and are modulated by the aperture board 5. More specifically, movement of the ions is prevented or accelerated depending on the polarity of the selection electrode 5*a* of the aperture board, i.e., whether the selection electrode 5*a* is positive or negative to the common electrode 5*b*.

According to the present invention shown in FIGS. 3 A and B, although the dielectric breakdown in the air occurs due to the high voltage on the positive electrode 4, the undesired discharge is fired only between the positive electrode 4 and the shield board 14, and therefore, the aperture board 5 can be protected from the discharge, and the circuits connected to the aperture board 5 can also be protected. Further, most of the ozone gas generated by said undesired discharge remains in the shield board 14, so that it does not corrode said aperture board 5.

Figure 5:
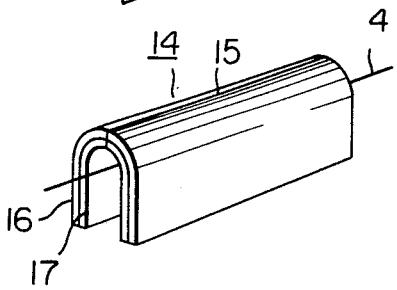
FIG. 5 is an enlarged view of the other shield board 14.

FIG. 5 shows another structure of the shield board 14, which comprises an inverted U-shaped dielectric member 16, and a thin conductive layer 17 circumscribed with said member 16. Said long slit 15 is also provided on the top of the shield board 14. The shield board 14 of FIG. 5 can be directly attached to the aperture board 5.

Figure 6:
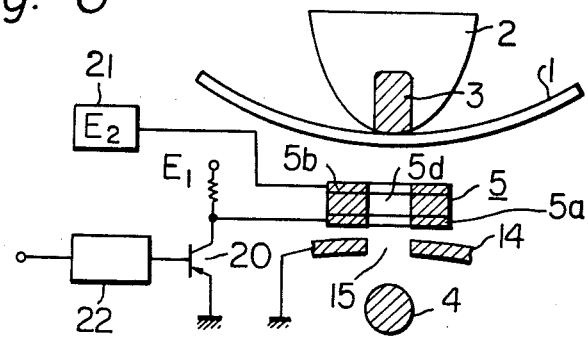
FIG. 6 is a brief circuit diagram concerning the shield board 14.

FIG. 6 shows a brief circuit diagram concerning a conductive shield board 14. In FIG. 6, the same reference numbers refer to the same members as those of FIG. 3 A. The shield board 14 is, in this embodiment, grounded, although any other potential can be applied to the shield board 14 without reducing the effect of the same.

Each cell of the separated conductive layer 5*a* is connected to an output of a drive circuit 20, the input of which is connected to the output of a selection circuit 22. The selection circuit 22, which is connected to a pattern generator (not shown), selects the cells to which voltage $E_1$ is applied according to the pattern to be printed. Since there are a plurality of cells on the layer 5*a*, a plurality of drive circuits 20, must be provided. However, only one representative drive circuit 20 is shown. The common layer 5*b* is electrically connected to the D.C. source 21.

As is apparent from the above explanation, an improved ink mist type high speed printer which prevents the corrosion of the aperture board and damage to its relating circuits, has been found.

Although it has been described with respect to embodiments, it need not be so limited, as changes and modifications may be made which would fall within the scope of the invention as defined by the appendant claims.

Finally, reference numbers used in this specification are listed below.

| | | | |
|---|---|---|---|
| 1; | printing medium | 2; | platen |
| 3; | negative electrode | 4; | positive electrode |
| 5; | aperture board | 5a; | selection electrode |
| 5b; | common electrode | 5c; | dielectric layer |
| 5d; | aperture | 6; | mist tank |
| 7; | ink | 8; | exciter |
| 9; | main pump | 10; | condenser |
| 11; | cooler | 12; | frame |
| 13; | aperture leg | 14; | shield board |
| 15; | slit | 16; | dielectric layer |
| 17; | conductive layer | 18; | ink mist |
| 20; | drive circuit | 21; | D.C. source |
| 22; | selection circuit | | |

What is claimed is:

1. An ink mist type printer for use in printing information on a printing medium, comprising means for generating an ion stream including a pair of spaced electrodes to which a high voltage is applied; means positioned between said electrodes for modulating said ion stream including an electrically controlled aperture board having a plurality of apertures therein, said apertures being positioned in at least one aligned row through which the ion stream passes and is modulated, means for supplying an ink mist between said aperture board and one of said electrodes whereby the modulated ion stream charges the mist according to the pattern to be printed on a printing medium arranged parallel to the flow of said ink mist between said one electrode and the aperture board whereby characters are printed on said medium by the attraction to said one electrode of the charged ink mist; and a conductive corona discharge shield board located between the other of said electrodes and said aperture board, said shield board having a narrow slit formed therein located generally in parallel alignment with the other of said electrodes and the row of apertures in said aperture board.

2. An ink mist type printer according to claim 1, wherein said conductive shield board comprises a dielectric layer directly circumscribed with the aperture board and a conductive layer circumscribed with said dielectric layer.

3. An ink mist type printer according to claim 1, wherein said conductive shield board is electrically connected to the ground.

* * * * *